US007287895B2

(12) United States Patent
Lin et al.

(10) Patent No.: US 7,287,895 B2
(45) Date of Patent: Oct. 30, 2007

(54) HEAT-DISSIPATING STRUCTURE OF BACKLIGHT MODULE

(75) Inventors: Chun-Yen Lin, Banchiao (TW); Ching-Kun Lai, Changhua (TW)

(73) Assignee: AU Optronics Corporation, Hsinchu (TW)

( * ) Notice: Subject to any disclaimer, the term of this patent is extended or adjusted under 35 U.S.C. 154(b) by 2 days.

(21) Appl. No.: 11/168,672

(22) Filed: Jun. 28, 2005

(65) Prior Publication Data

US 2006/0193134 A1 Aug. 31, 2006

(30) Foreign Application Priority Data

Feb. 25, 2005 (TW) ..... 94105748 A

(51) Int. Cl.
*F21V 7/04* (2006.01)
*F21V 29/00* (2006.01)
*F21V 7/20* (2006.01)

(52) U.S. Cl. ..... 362/633; 362/632; 362/634; 362/373; 362/218

(58) Field of Classification Search ..... 362/373, 362/355, 33, 561, 580, 240, 218, 97, 236, 362/216, 294, 632–634, 364, 581; 349/58
See application file for complete search history.

(56) References Cited

U.S. PATENT DOCUMENTS 6,997,582 B2 * 2/2006 Yang et al. ..... 362/373
7,063,439 B2 * 6/2006 Peng et al. ..... 362/218
7,165,862 B2 * 1/2007 Wu ..... 362/218
2004/0001340 A1 * 1/2004 Shin ..... 362/225
2005/0057946 A1 * 3/2005 Kim ..... 362/561
2005/0141220 A1 * 6/2005 Kim et al. ..... 362/240
2005/0157516 A1 * 7/2005 Chen et al. ..... 362/555
2005/0265020 A1 * 12/2005 Kim ..... 362/225
2006/0103774 A1 * 5/2006 Han et al. ..... 349/58
2006/0103775 A1 * 5/2006 Chung ..... 349/58
2006/0158897 A1 * 7/2006 Choi et al. ..... 362/561
2006/0181867 A1 * 8/2006 Choi et al. ..... 362/97
2006/0291254 A1 * 12/2006 Jeong et al. ..... 362/632

FOREIGN PATENT DOCUMENTS

CN 1469170 A 1/2004

* cited by examiner

*Primary Examiner*—Jong-Suk (James) Lee
*Assistant Examiner*—David Crowe
(74) *Attorney, Agent, or Firm*—Birch, Stewart, Kolasch & Birch, LLP

(57) ABSTRACT

A backlight module and the heat-dissipating structure thereof are provided. An electrode sheath, with high thermal conductivity and electrical insulation, is arranged to hold the electrode of the lamp and to make a contact with the front bezel and the back bezel, which are made of high thermal-conductive material. Hence, the heat energy produced by the lamp will be conducted to the front band back bezels through the electrode sheath.

18 Claims, 3 Drawing Sheets

HEAT-DISSIPATING STRUCTURE OF BACKLIGHT MODULE

FIELD OF THE INVENTION

The present invention relates to a light source module, and more particularly relates to a backlight module and a corresponding heat-dissipating structure.

DESCRIPTION OF THE PRIOR ART

The lamp is usually used as the light source in the backlight module of the display device. However, by the need of the big sized display device, the number of the lamps used in the backlight module and the size of the lamp are in the trend of increasing, and the temperature of the backlight module is increased at the same time and it is hard to avoid. Especially, when the high temperature generated in the electrode of the lamp cannot be flowed out, the lighting efficiency and the even illumination had been affected. Therefore, there is a need for the heat-dissipating structure to flow the heat out efficiently and keep the quality of light, and especially a heat-dissipating structure can efficiently flow out the heat generated in the electrode of the lamp.

SUMMARY OF THE INVENTION

According to the background of the invention described above, the temperature is increased during the operation of the backlight module and having the problem of affecting the lighting quality. Hence, a backlight module with a heat-dissipating structure is needed to overcome the problem. The purpose is to flow the high temperature out of the electrode sheath and maintain the light quality of the backlight module, when the heat was generating in the operation of the backlight module.

According to the purpose described above, a backlight module with a heat-dissipating structure is provided in the present invention. An electrode sheath with the properties of dielectric and heat conduction is provided and is contacted to the external frame in the surrounding of the backlight module and the backboard in the back of the backlight module. Therefore, the heat generated during the operation of the lamp can be conducted to the external frame and the backboard and then flowed out to maintain the light quality of the backlight module.

BRIEF DESCRIPTION OF THE DRAWINGS

The accompany drawings incorporated in and forming a part of the specification illustrate several aspects of the present invention, and together with the description serve to explain the principles of the invention. In the drawings.

DESCRIPTION OF THE PREFERRED EMBODIMENT

Figure 1A:
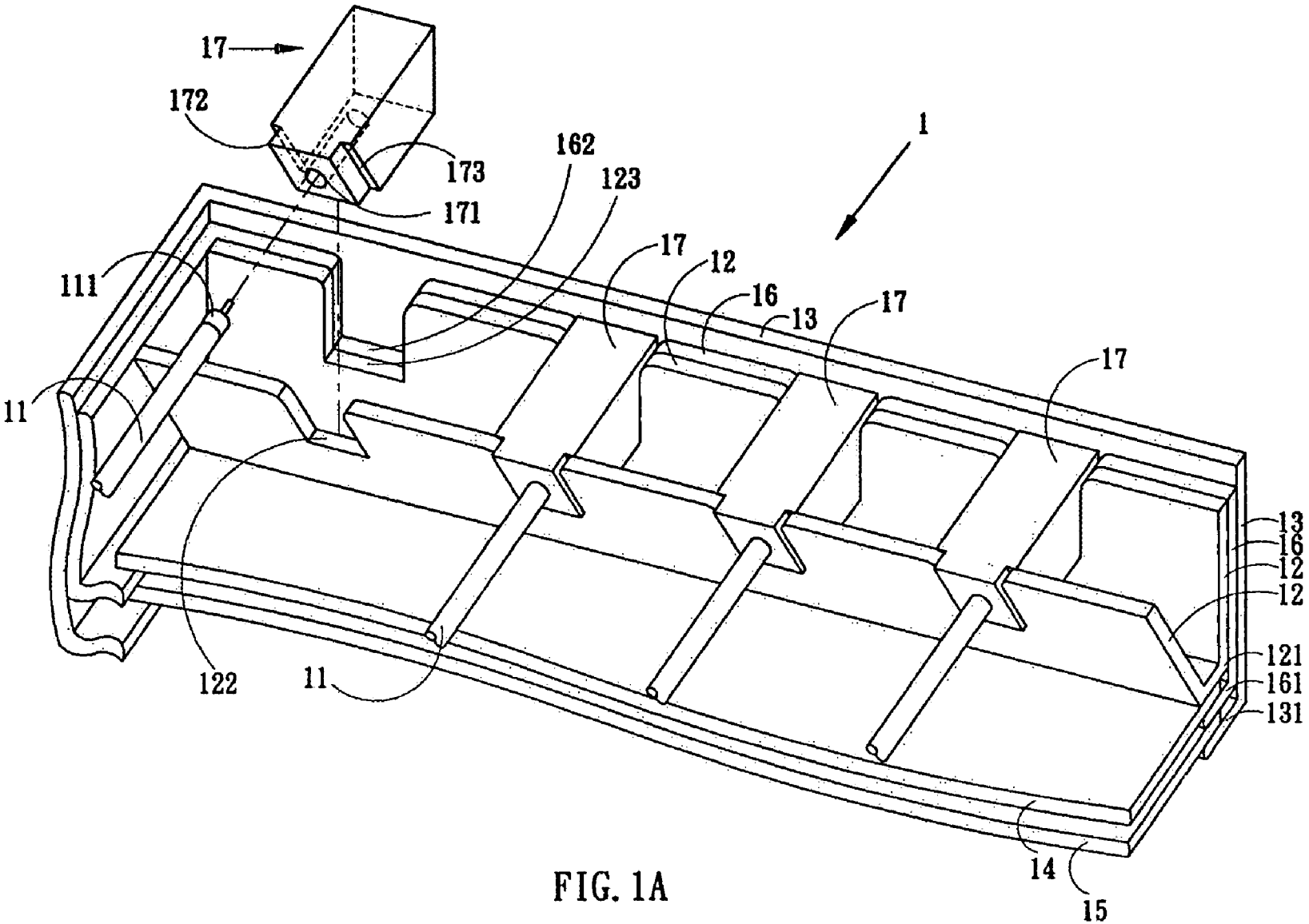
FIG. 1A is a perspective view illustrating one of the preferred embodiments of the present invention providing an electrode sheath of the backlight module contacted to the inside of the external frame.

In accordance with one of the preferred embodiments of the present invention, a backlight module with a heat-dissipating structure is provided. First, referring to FIG. 1A, showing a 3-dimensional view of the back of the backlight module (assume the surface of the light output of the backlight module is the front side). The main structure of the backlight module 1 includes a plurality of lamps 11, a support bracket 12 for supporting the lamps 11, which is located on the opposite sides and inside the backlight module, and an external frame 13 disposed in the surrounding of the lamps 11 and the support bracket 12. In the present invention, the external frame 13 is also called the front bezel, which is made by metal or other thermal conductive materials. And the support bracket 12 has a groove-type structure, so that a V-shaped cross-section is formed. Wherein the bottom plate 121 with the groove shape inside the support bracket 12 disposes the optical sliced set 14 and the display plate 15 together with the shelf 131 vertically extended from the external frame 13. The optical sliced set 14 and the display plate 15 are clipped by the bottom plate 121 of the groove-type structure inside the support bracket 12 and the shelf 131 vertically extended from the external frame 13. Besides, in the outside of the optical sliced set 14 and display plate 15 and between the support bracket 12 and the external frame 13, the backlight module 1 disposed in at least one frame 16 and the shelf 161 extended vertically from the frame 16 to be the buffer material when the multi-layers' elements assembled in the stack. And the material of the frame 16 can be chosen from a plastic or other high polymer material.

Still referring to FIG. 1A, in the present embodiment, the electrode 111 in the two ends of the each lamp 11 is encapsulated by an electrode sheath 17 and avoided the situation of the electric leakage happening. And the groove 171 is formed corresponding to the electrode 111 inside the electrode sheath 17, and is connected to the conductive wire (not shown) and provided the power. Besides, the two corresponding sides of the support bracket 12 in the backlight module 1 formed a holding plate and coupled with the electrode sheath 17, for example, there are the corresponding electrode sheath 17 and the first notch 122 and 123 formed in the two sides of the groove shape of the support bracket 12. Therefore, the electrode sheath 17 is disposed in the corresponding first notch 122 and 123, and the outside of its surface is contacted to the inside of the external frame 13. If there is a frame 16 is disposed between the support bracket 12 and the external frame 13 in the present invention, the notch 162 is formed as the look of the corresponding electrode sheath 17 and then placed in the frame 16.

In the backlight module of the present invention, the heat-dissipating of the lamp is achieved by the cooperation of the electrode supporting cover 17 and the external frame 13. Therefore, in the embodiment, an electrode supporting cover 17 with good dielectric properties and thermal conductivity is used, for example, a rubber with high thermal conductivity is chosen. Thereafter, the electrode supporting cover 17 can have the functions of the electrical isolation and the protection, the heat generated during operating the lamp 11 can be flowed out from the electrode 17 and conducted to the external frame 13, and have the result of the heat-dissipating and maintain the lighting quality of the backlight module. On the other hand, in the embodiment, the electrode sheath 17 is formed a raised portion 172 in the side faced to the lamp 11. The look of the raised portion 172 is fitted with the first notch 122. Therefore, when the electrode sheath 17 is disposed in the first notch 122, 123, and notch 162, the raised portion 172 is inserted into the first notch 122 and the holding portion 173 is against to the support bracket 12 and closed the first notch 122 to firm the electrode sheath 17.

In the embodiment, there are the first notch 122, 123, and notch 162 formed in the support bracket 12 and the frame 16 corresponding to the raised portion 172 and the shape of the electrode sheath 17 itself. But it is not limited the U-type notch provided in the embodiment, as long as the electrode sheath 17 can be fitted to each other and assembled together. For example, when the electrode sheath 17 has a V or wedge type raised portion and body, it can be formed V or wedge openings in the support bracket 12 or frame 16. However, no matter how the electrode sheath 17 is disposed on the support bracket 12 and the frame 16, the electrode sheath 17 can be contacted with the external frame 13. Therefore, the lamp 11 can conduct the heat generating during the operation to the external frame 13 and help the heat-dissipating.

Figure 1B:
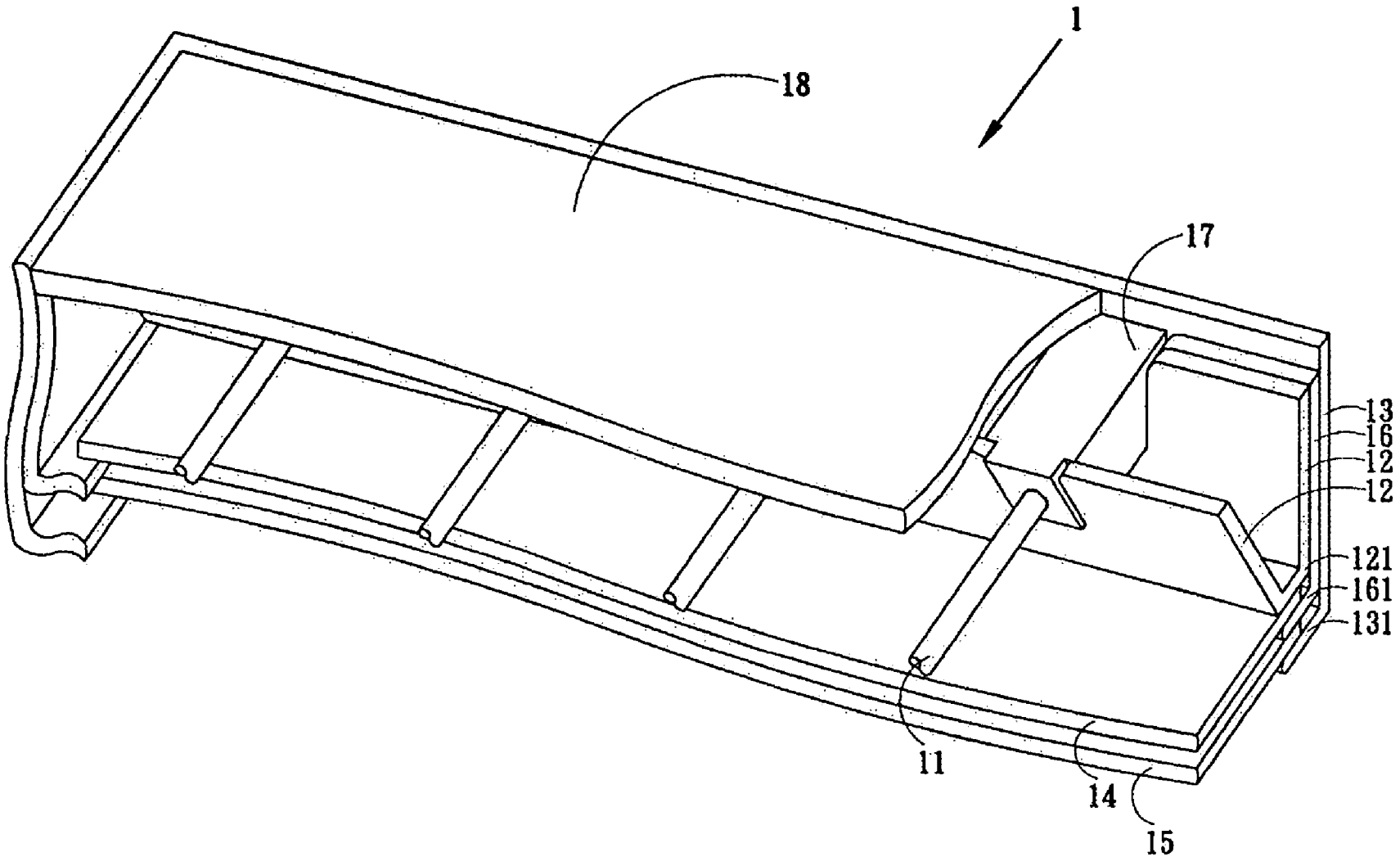
FIG. 1B is a construction drawing illustrating one of the preferred embodiments of the present invention providing an electrode sheath of the backlight module contacted to the inside of the external frame and the backboard at the same time.

Referring to the FIG. 1B, when each of lamps 11 is disposed in the support bracket 12 and the frame 16 by the electrode sheath 17, the backboard 18 made by metal or other thermal conductive materials is disposed in the back of the backlight module 1 and firmed the electrode protecting 17 and the support bracket 12. At this time, the backboard 18 can be stuck to one of the electrode sheaths 17 that can conduct the heat generating at the operation of the lamp 11 to the external frame 13 and backboard 18 and enhance the effect of the heat-dissipating. And the heat generating at the operation of the lamp 11 can flow out to the backboard by air. Therefore, in the embodiment, the heat-dissipating structure provided in the backlight module can conduct the heat of the backlight module 1 to the external frame 13 and backboard 18 by contacting or air and then flowed out.

Figure 1C:
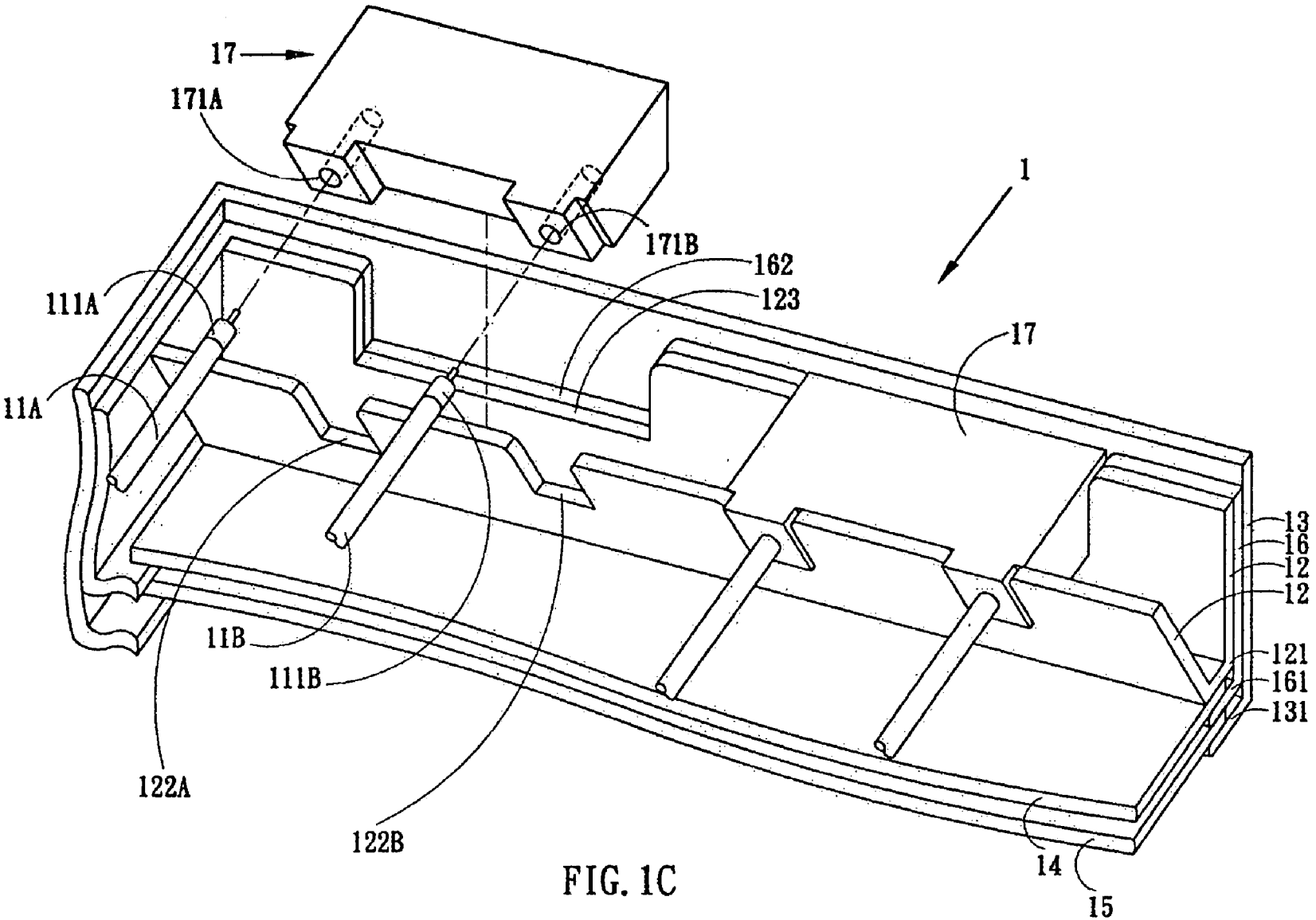
FIG. 1C is a construction drawing illustrating one of the better embodiments of the present invention providing two adjacent lamps sharing one electrode sheath in the backlight module.

Referring to the FIG. 1A, in the embodiment, the electrode 111 of each lamps should correspond to an electrode sheath 17. But, in the other embodiments of the present invention, the same side of the electrode in a plurality of the parallel lamps can share the same one electrode sheath. And the electrode sheath 17 can be formed a plurality of grooves corresponding to the outside of the electrode sheath. For example, referring to the FIG. 1C, the electrode 111A and 111B of two adjacent lamps 11 can be disposed in the groove 171A and 171B of the electrode sheath 17 and there are notch 122A, 122B, 123 and 162 formed in the support bracket 12 and the frame 16 can be fitted in the shape of the electrode sheath 17. Therefore, it can increase the surface area of the electrode sheath 17 contacted with the external frame 13 to enhance the efficiency of the heat-dissipating. The electrode sheath 17 provided in the present invention can be used in the non-linear lamp, such as U-type or S-type lamp, and the two extreme ends of the electrode can be disposed in the groove of the electrode sheath 17 and conduct the heat to the external frame 13 by the electrode sheath.

The foregoing description is not intended to be exhaustive or to limit the invention to the precise forms disclosed. Obvious modifications or variations are possible in light of the above teachings. In this regards, the embodiment or embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

What is claimed is:

1. A heat-dissipating structure for dissipating heat generated from at least one lamp of a backlight module, comprising:

an external frame;

a support bracket having a first notch disposed at inside of said external frame; and an electrode sheath disposed on said support bracket by engaging with said first notch, said electrode sheath comprising:

a first surface having at least one groove to hold the at least one lamp;

a second surface opposite to the first surface to fit and contact the inside surface of said external frame; and a frame disposed between the support bracket and said external frame, wherein said frame has a notch for holding said electrode sheath;

whereby the heat generated from the lamp is conducted to said electrode sheath, and is thus conducted to said external frame through the second surface to be dissipated away.

2. The heat-dissipating structure of claim 1, wherein said electrode sheath is made of a thermal conductive and dielectric material.

3. The heat-dissipating structure of claim 1, wherein said external frame is made of a heat conductive material.

4. The heat-dissipating structure of claim 3, wherein said heat conductive material comprises a metal.

5. The heat-dissipating structure of claim 1, further comprising a backboard disposed on the back of the backlight module, wherein said support bracket has a bottom plate, said electrode sheath has a third surface parallel and opposite to the bottom plate, and said backboard is stacked on the third surface, whereby the heat generated by the lamps is also directly conducted to said backboard through the third surface to be dissipated.

6. The heat-dissipating structure of claim 5, wherein said backboard is made of a metal.

7. The heat-dissipating structure of claim 5, wherein said support bracket has a V-shaped cross-section area, and has said bottom plate at its bottom part.

8. The heat-dissipating structure of claim 1, wherein said electrode sheath has one groove.

9. The heat-dissipating structure of claim 1, wherein said electrode sheath has a plurality of grooves.

10. A backlight module, comprising:

an external frame;

two support brackets disposed in two opposite sides of inside of said external frame;

at least one lamp;

at least two electrode sheaths, each sheath having a first surface and a second surface, the second surface being opposite to the first surface, each sheath encapsulating one side of each of said lamp into the first surface, wherein each of said electrode sheaths is disposed in one of said two support brackets, and the second surface fits and contacts the inside surface of said external frame; and a frame placed between said two support brackets and said external frame, wherein said frame has a plurality of notches to hold said electrode sheaths;

whereby the heat generated from said lamp is conducted to said at least two electrode sheaths, and is thus conducted to said external frame through the second surface to be dissipated away.

11. The backlight module of claim 10, wherein said at least two electrode sheaths are made of a heat conductive dielectric material.

12. The backlight module of claim 10, wherein each of said two support brackets has a holding place to couple with one of said at least two electrode sheaths.

13. The backlight module of claim 10, wherein said external frame is made of a metal.

14. The backlight module of claim 10, further comprising a backboard stacked on the back of said backlight module, wherein said support bracket has a bottom plate, said electrode has a third surface parallel and opposite to the bottom plate, and said backboard is stacked on the third surface of each of said at least two electrode sheaths, whereby the heat generated by said at least one lamp is also directly conducted to said backboard through the third surface to be dissipated.

15. The backlight module of claim 14, wherein said backboard is made of a metal.

16. backlight module of claim 14, wherein each of said support bracket has a V-shaped cross-section area, and has said bottom plate at its bottom part.

17. The backlight module of claim 10, wherein each of said at least two electrode sheaths has at least one groove, each groove holding an electrode of one terminal of one of said at least one lamp.

18. The backlight module of claim 17, wherein each of said at least two electrode sheaths has two grooves.

* * * * *